US008434395B1

(12) United States Patent
Petrosillo et al.

(10) Patent No.: US 8,434,395 B1
(45) Date of Patent: May 7, 2013

(54) PROTECTIVE BALLISTIC SHIELD

(75) Inventors: Frank Petrosillo, West Milford, NJ (US); Daniel Gennarelli, East Hanover, NJ (US); Louis Campanile, Denville, NJ (US); Chad Young, Macomb, MI (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 75 days.

(21) Appl. No.: 12/652,852

(22) Filed: Jan. 6, 2010

(51) Int. Cl.
*F41H 5/22* (2006.01)

(52) U.S. Cl.
USPC ..... 89/36.01; 89/931

(58) Field of Classification Search ..... 89/36.01, 89/36.06–36.09, 36.13–36.15, 929, 930, 89/931, 935
See application file for complete search history.

(56) References Cited

U.S. PATENT DOCUMENTS

| | | | | |
|---|---|---|---|---|
| 7,478,580 | B1 * | 1/2009 | Parimi et al. | 89/36.13 |
| D622,182 | S * | 8/2010 | Parimi et al. | D12/12 |
| 7,823,498 | B2 * | 11/2010 | Schneider et al. | 89/36.08 |
| 7,942,092 | B1 * | 5/2011 | Kiel et al. | 89/36.13 |

* cited by examiner

*Primary Examiner* — Michael Carone
*Assistant Examiner* — Reginald Tillman, Jr.
(74) *Attorney, Agent, or Firm* — Michael C. Sachs

(57) ABSTRACT

A protective shield may include an inboard shield assembly having an inboard shield and an inboard base. The inboard shield may include a forward plate fixed at an angle to a center plate and a rear plate fixed at an angle to the center plate. The center plate may include a window opening and a window fixed over the window opening. The protective shield may also include an outboard shield assembly having an outboard shield and an outboard base. The outboard shield may include a forward plate fixed at an angle to a center plate and a rear plate fixed at an angle to the center plate. The center plate may include a window opening and a window fixed over the window opening. A splice plate may connect portions of the inboard and outboard bases.

10 Claims, 8 Drawing Sheets

PROTECTIVE BALLISTIC SHIELD

STATEMENT OF GOVERNMENT INTEREST

The inventions described herein may be manufactured, used and licensed by or for the U.S. Government for U.S. Government purposes.

BACKGROUND OF THE INVENTION

The invention relates in general to protective shields and in particular to shields for protection from ballistic threats.

Some mounted machine guns and artillery pieces may be equipped with metal armor plates to protect the gunners from sniper fire and shrapnel from explosions. Some gun shields may be improvised in the field using salvaged metal plates. In the Vietnam War, the crews of some armored fighting vehicles and PT Boats would affix metal plates to their machine guns. After the Vietnam War, gun shields fell out of widespread use.

Modern battlegrounds are filled with weapon fire. The weapon fire presents a grave risk to soldiers who may be exposed when firing at the enemy. The weapon fire may include incoming fire from elevated, precision-fire weapons, and ground-born threats, such as mines and improvised explosive devices. In particular, many casualties are hit in areas not protected by body armor or helmets, such as the neck or face. A disadvantage of gun shields may be that they limit the visibility of the user. In the case of vehicle-mounted guns, gun shields may also adversely affect the performance of tasks other than firing a gun.

Military tanks, such as the Abrams tank, may include a turret with one or more hatches. On the Abrams, one of the turret hatches is located at the tank commander's station. Mounted adjacent the tank commander's hatch may be a weapon, such as a .50 caliber machine gun. When using the .50 caliber machine gun, the tank commander may be vulnerable to enemy fire. A need exists for a protective shield for the operator of the weapon at the tank commander's station.

SUMMARY OF THE INVENTION

It is an object of the invention to provide a protective shield.

It is another object of the invention to provide a protective shield configured for the tank commander's station of a tank.

One aspect of the invention may be a protective shield. The protective shield may include an inboard shield assembly and an outboard shield assembly. The inboard shield assembly may include an inboard shield and an inboard base. The inboard shield may include a forward plate fixed at an angle to a center plate and a rear plate fixed at an angle to the center plate. The center plate may include a window opening and a window fixed over the window opening.

The outboard shield assembly may include an outboard shield and an outboard base. The outboard shield may include a forward plate fixed at an angle to a center plate and a rear plate fixed at an angle to the center plate. The center plate may include a window opening and a window fixed over the window opening. A splice plate may connect portions of the inboard and outboard bases.

The inboard base may include a circular member having a generally planar upper surface and a plurality of base supports extending from a lower surface of the circular member. The outboard base may include a circular member having a generally planar upper surface and a plurality of base supports extending from a lower surface of the circular member. The forward plate, center plate, and rear plate of the inboard shield may each be substantially planar and the forward plate, center plate, and rear plate of the outboard shield may each be substantially planar.

Each of the base supports for the inboard base and the outboard base may include a boss inserted in an opening in the inboard base circular member or the outboard base circular member.

The shield may include an inboard shield sill having a generally horizontal upper surface. The inboard sill may be attached to an interior of the inboard shield. An outboard shield sill may have a generally horizontal upper surface and may be attached to an interior of the outboard shield.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A protective shield in accordance with the invention may be used wherever protection is needed. In one embodiment, the protective shield may be used at the tank commander's station on an M1A1 Abrams tank. The protective shield may provide cover, concealment, and ballistic protection for the operator at the M1A1 commander's weapons station.

The protective shield may be fixed around the commander's weapon station at the lifting I-hooks and the drain holes. The protective shield may include inboard and outboard portions that may be connected with a splice plate. A hatch stop may be used to prevent the commander's hatch from opening past its vertical position. One advantage of the invention is that no permanent modifications to the M1A1 tank may be required.

Figure 1:
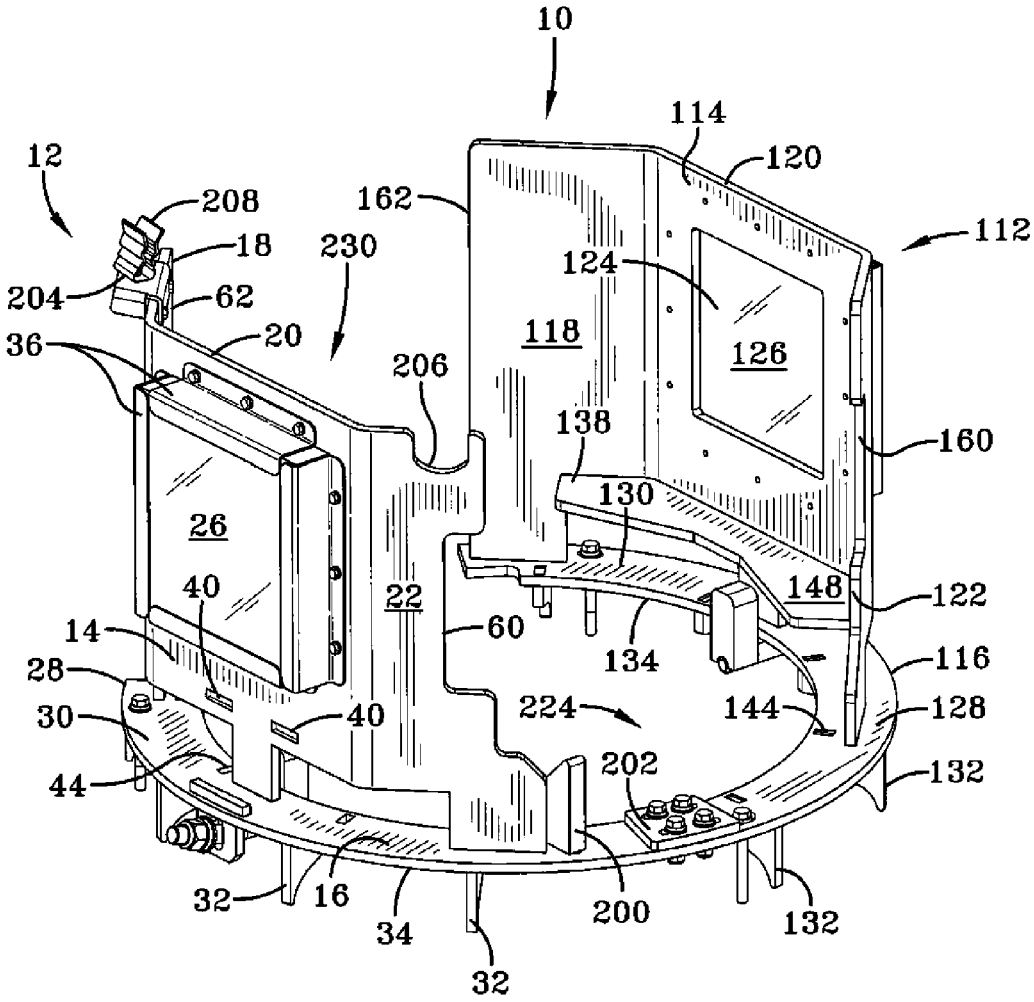
FIG. 1 is a perspective view of one embodiment of a protective shield.
Figure 2:
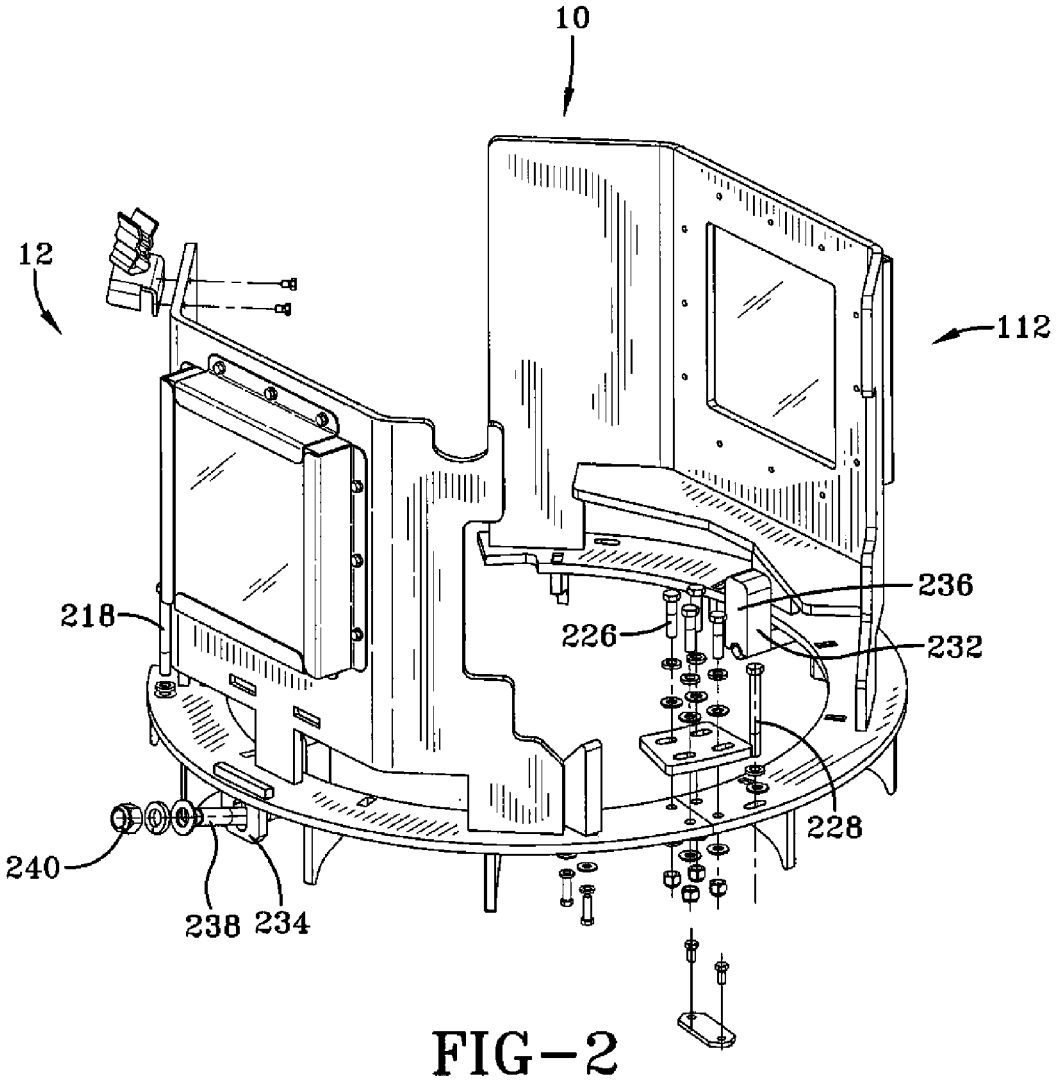
FIG. 2 is a partially exploded view of FIG. 1.
Figure 10C:
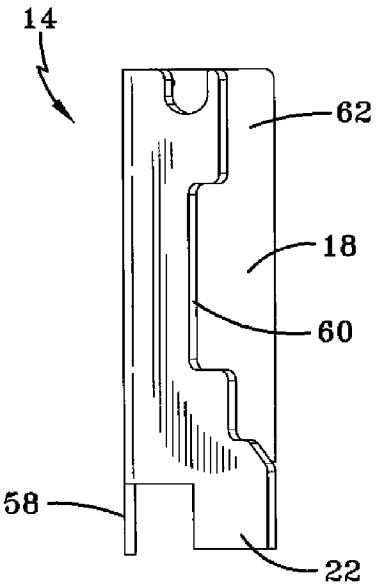
FIGS. 10A, B, and C are front, bottom, and side views, respectively, of an exemplary inboard shield.
Figure 10A:
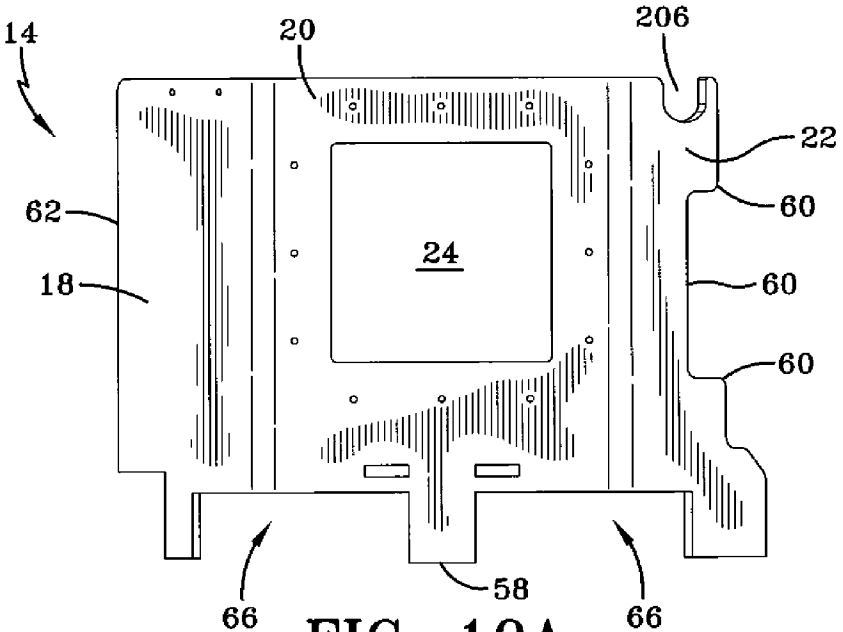
Figure 10B:
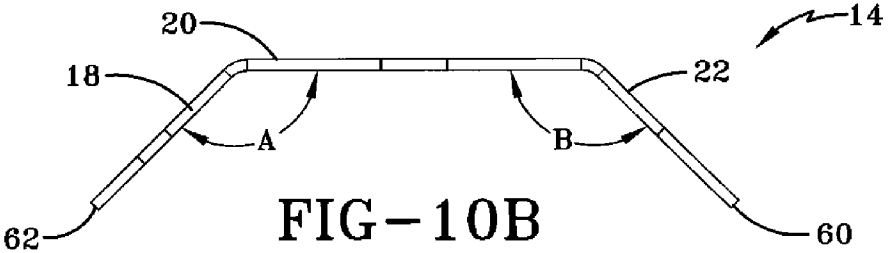

Referring to FIGS. 1 and 2, a protective shield 10 may include an inboard shield assembly 12 having an inboard shield 14 and an inboard base 16. The inboard shield 14 may include a forward plate 18 fixed at an angle A (FIG. 10B) to a center plate 20 and a rear plate 22 fixed at an angle B (FIG. 10B) to the center plate 20. The center plate may include a window opening 24 and a window 26 fixed over the window opening 24, (FIG. 10A). Angles A and B may or may not be equal. Angles A and B may be a range of about 30 to about 60 degrees. In one embodiment, angles A and B are about 45 degrees.

Protective shield 10 may include an outboard shield assembly 112 having an outboard shield 114 and an outboard base 116. The outboard shield 114 may include a forward plate 118 fixed at an angle C (FIG. 11B) to a center plate 120 and a rear plate 122 fixed at an angle D (FIG. 11B) to the center plate 120. The center plate 120 may include a window opening 124 and a window 126 fixed over the window opening 124. A splice plate 202 may connect portions of the inboard and outboard bases 16, 116. Angles C and D may or may not be equal. Angles C and D may be a range of about 30 to about 60 degrees. In one embodiment, angles C and D are about 45 degrees.

The tank commander's station may include periscopes for viewing the area around the tank. To provide an area for viewing through the periscopes, the inboard shield 14 and the outboard shield 114 may define viewing openings 66 (FIG. 10A) and 166 (FIG. 11A) in lower portions of the respective shields 14, 114.

The inboard base 16 may include a circular member 28. Circular member 28 may include a generally planar upper surface 30 and a lower surface 34. A plurality of base supports 32 may extend from the lower surface 34 of the circular member 28. The outboard base 116 may include a circular member 128. Circular member 128 may include a generally planar upper surface 130 and a lower surface 134. A plurality of base supports 132 may extend from the lower surface 134 of the circular member 128.

The splice plate 202 may overlap portions of the inboard base circular member 28 and the outboard base circular member 128. Although the circular members 28, 128 may abut at splice plate 202, the rear plates 22, 122 may not abut each other. Rather, the facing ends 60, 160 (FIGS. 1, 10A-C, 11A-C) of the rear plates 22, 122 may define an open area 224 therebetween.

The facing ends 62, 162 (FIGS. 1, 10A-C, 11A-C) of the inboard shield forward plate 18 and the outboard shield forward plate 118 may also define an open area 230 (FIG. 1) therebetween. The open area 230 may be further defined by facing ends 64, 164 (FIGS. 8 and 9) of the inboard shield circular member 28 and the outboard shield circular member 128. Open area 230 may be used to access a weapon mounted on a vehicle. The weapon may be, for example, a .50 caliber machine gun and the vehicle may be, for example, a military tank.

Each of the forward plate 18, center plate 20, and rear plate 22 of the inboard shield 14 may be substantially planar. Each of the forward plate 118, center plate 120, and rear plate 122 of the outboard shield 114 may be substantially planar. The forward plates 18, 118; center plates 20, 120; rear plates 22, 122; circular members 28, 182; base supports 32, 132, and splice plate 202 may comprise, for example, steel armor plate. The steel armor plate may have a thickness of, for example, about 0.5 inches.

Figure 7:
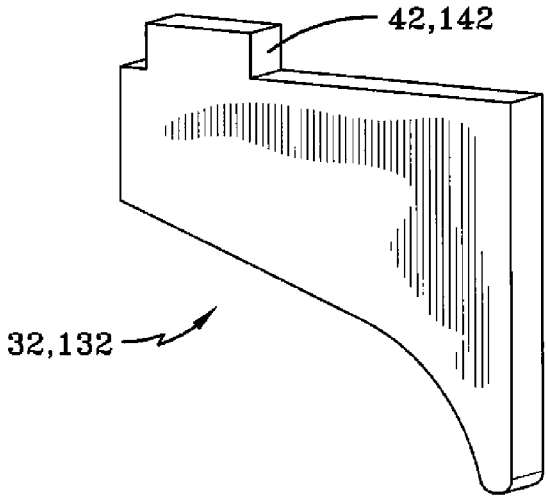
FIG. 7 is a perspective view of an exemplary base support.

FIG. 7 is a perspective view of an exemplary base support 32, 132. Each base support 32 for the inboard base 16 may include a boss 42 inserted in an opening 44 (FIG. 1) in the inboard base circular member 28. Each base support 132 for the inboard base 116 may include a boss 142 inserted in an opening 144 (FIG. 1) in the inboard base circular member 128.

Figure 3:
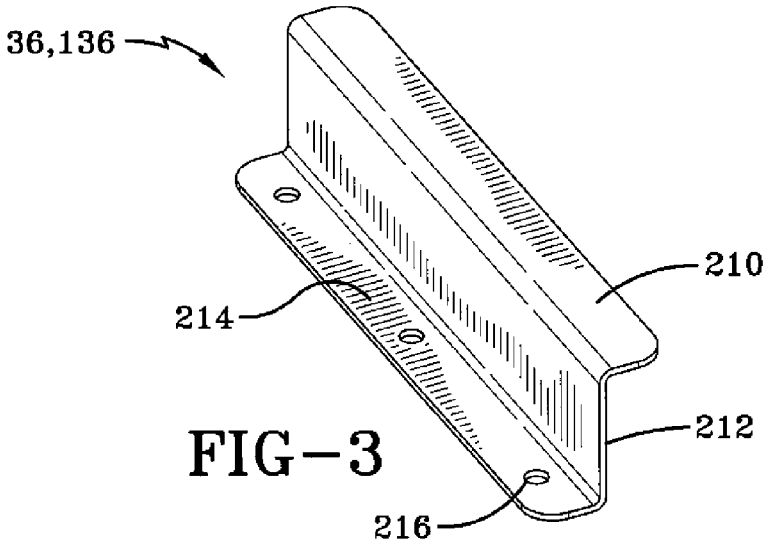
FIG. 3 is a perspective view of an exemplary window bracket.

Windows 26, 126 may comprise, for example, laminated ballistic glass. Window 26 may be fixed to center plate 20 using a plurality of generally Z-shaped brackets 36. FIG. 3 is a perspective view of an exemplary window bracket 36, 136. Bracket 36 may comprise, for example, steel having a thickness of, for example, about 0.10 inches. Bracket 36 may include a surface 214 with fastener openings 216 therein. Surface 214 may lie against the center plate 20. Surface 212 of bracket 36 may lie against the sides of window 26. Surface 210 of bracket 36 may lie against the outwardly facing front face of window 26. Surfaces of bracket 36 that contact window 26 may include a gasket material, such as neoprene, EPDM, foam rubber, etc., placed between the bracket surface and the window 26. Window 126 may be fixed to center plate 120 in a similar manner as described for window 26.

Figure 4A:
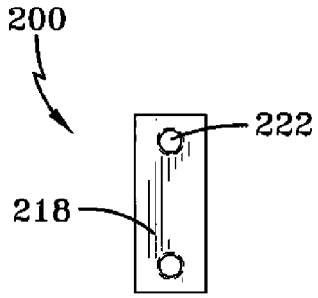
FIGS. 4A and 4B are bottom and side views, respectively, of an exemplary hatch stop.
Figure 4B:
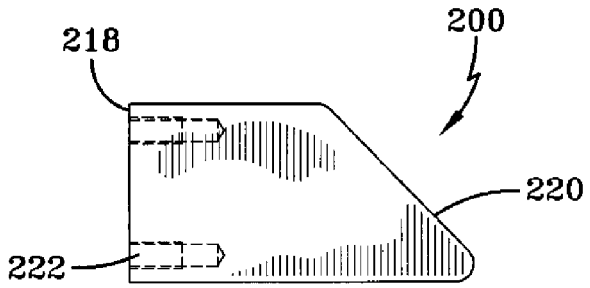

A hatch stop 200 may be fixed to one of the inboard base circular member 28 and the outboard base circular member 128. In the illustrated embodiment, the hatch stop 200 is fixed to the inboard base circular member 28. FIGS. 4A and 4B are bottom and side views, respectively, of an exemplary hatch stop 200. Hatch stop 200 may include a bottom surface 218 that may abut a top surface of inboard base circular member 28. Hatch stop 200 may include an angled surface 220 for engaging the comander's hatch (not shown) to prevent the commander's hatch from opening past its vertical position. By limiting the movement of the commander's hatch, the hatch stop 200 maintains the commander's hatch substantially vertical, which allows the commander's hatch to function as a protective shield for the open area 224 (FIG. 1) between the inboard shield rear plate 22 and the outboard shield rear plate 122.

Figure 5:
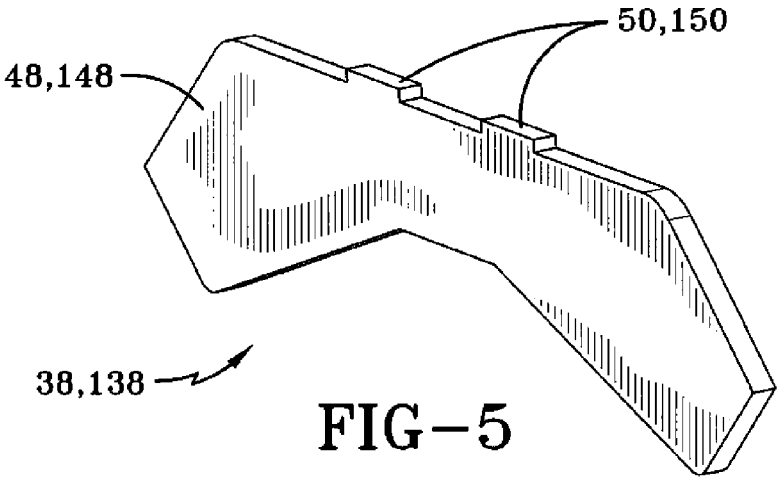
FIG. 5 is a perspective view of an exemplary sill.
Figure 11C:
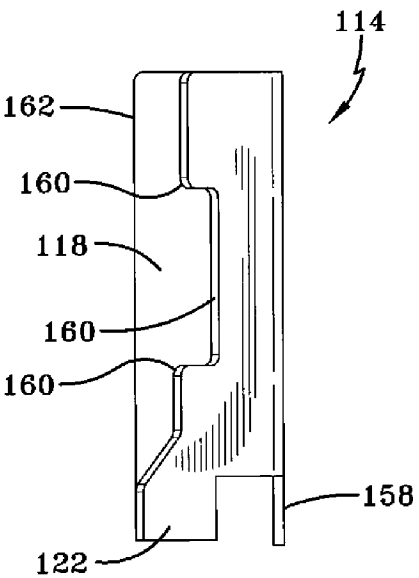
FIGS. 11A, B, and C are front, top, and side views, respectively, of an exemplary outboard shield.
Figure 11A:
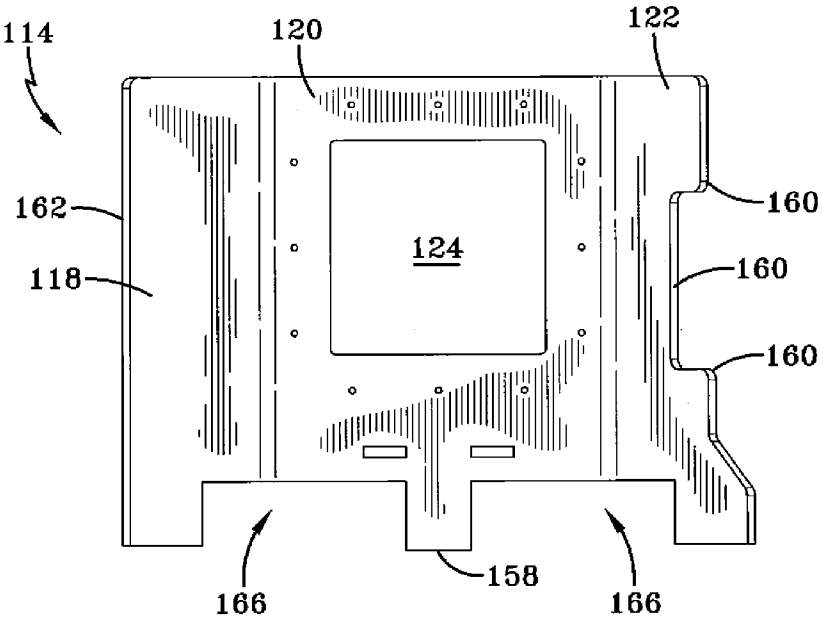
Figure 11B:
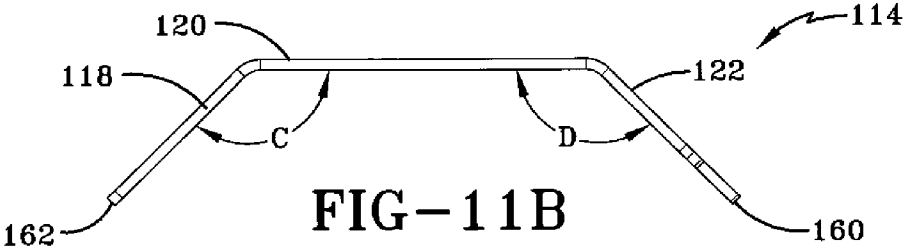

The inboard shield assembly 12 may include an inboard shield sill 38, (FIG. 5), having a generally horizontal upper surface 48. The inboard shield sill 38 may be attached to an interior of the inboard shield 14, for example, the center plate 20. The outboard shield assembly 112 may include an outboard shield sill 138 having a generally horizontal upper surface 148. The outboard shield sill 138 may be attached to an interior of the outboard shield 114, for example, the center plate 120. FIG. 5 is a perspective view of an exemplary sill 38, 138. Sill 38, 138 may include tabs 50, 150 for insertion in tab openings 40, 140, (FIG. 1), in respective inboard and outboard shields 14, 114. Sills 38, 138 may provide protection from enemy fire that may enter through the viewing openings 66, (FIG. 10A), and 166, (FIG. 11A).

Figure 6A:
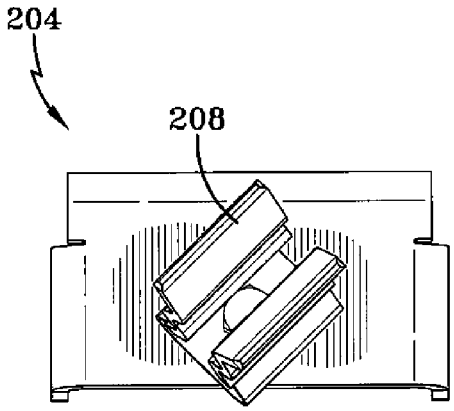
FIGS. 6A and 6B are top and perspective views, respectively, of an exemplary mounting bracket.
Figure 6B:
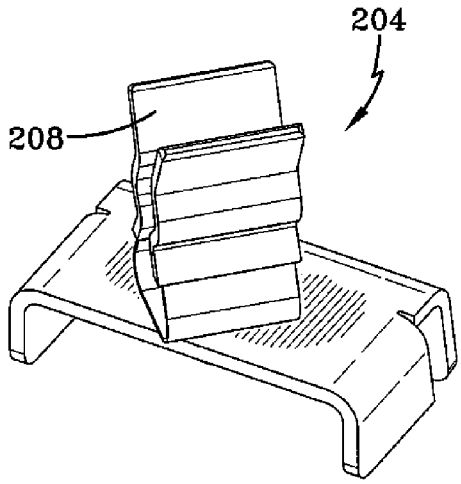

One of the inboard shield 14 and the outboard shield 114 may include a rack for a weapon. In the embodiment of FIG. 1, the rack may include a mounting bracket 204, (see also FIG. 6A, 6B), that is fixed to the forward plate 18 of the inboard shield 14. The mounting bracket 204 may include a spring clip 208 that may receive the forward end of a weapon, for example, the barrel of a weapon. The weapon may be, for example, an M4 rifle. The rack may further included a concave portion 206 formed in the rear plate 22 of inboard shield 14 for receiving the rearward end of a weapon, for example, the buttstock of a weapon. FIGS. 6A and 6B are top and perspective views, respectively, of an exemplary mounting bracket 204 having spring clip 208 fixed thereto.

Figure 8:
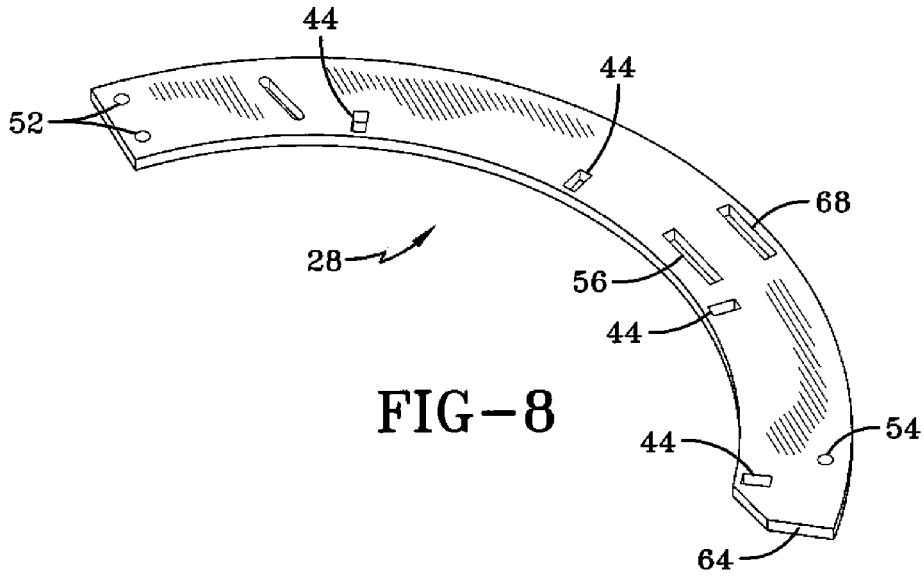
FIG. 8 is a perspective view of an exemplary inboard base circular member.
Figure 9:
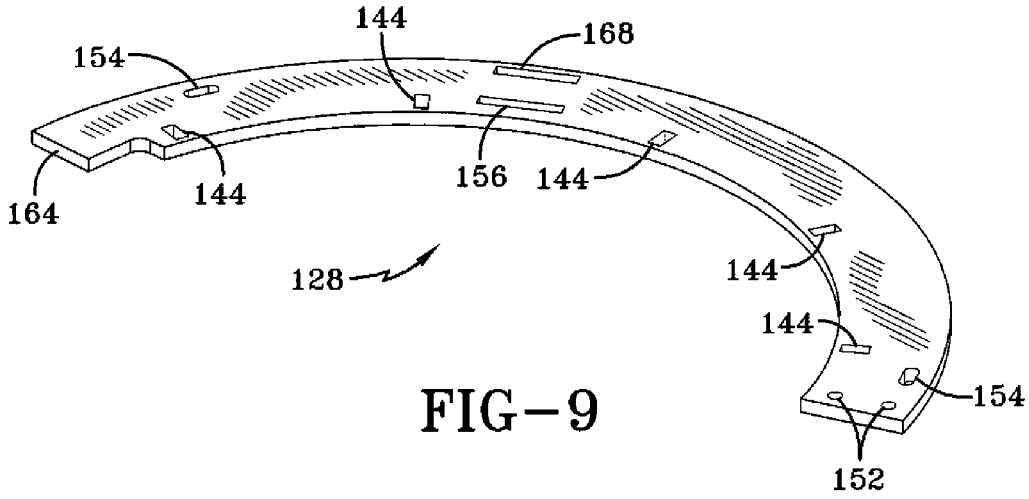
FIG. 9 is a perspective view of an exemplary outboard base circular member.

FIG. 8 is a perspective view of an exemplary inboard base circular member 28 and FIG. 9 is a perspective view of an exemplary outboard base circular member 128. Members 28 128 may include openings 44, 144 for receiving the bosses 42, 142 (FIG. 7) of the base supports 32, 132. Members 28, 128 may include openings 52, 152 for receiving fasteners 226 (FIG. 2) for fixing the splice plate 202. Members 28, 128 may include openings 54, 154 for receiving fasteners 228 for fixing the protective shield 10 to an object, such as a military tank. In the case of an M1A1 Abrams tank, fasteners 228 may be inserted in the threaded holes for the lifting I-hooks. Members 28, 128 may also include openings 56, 156 for center plate tabs 58, 158 (FIGS. 10A and 11A).

Figure 12:
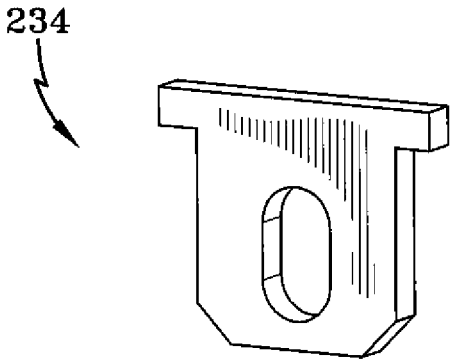
FIG. 12 is an enlarged view of an exemplary flange.
Figure 13:
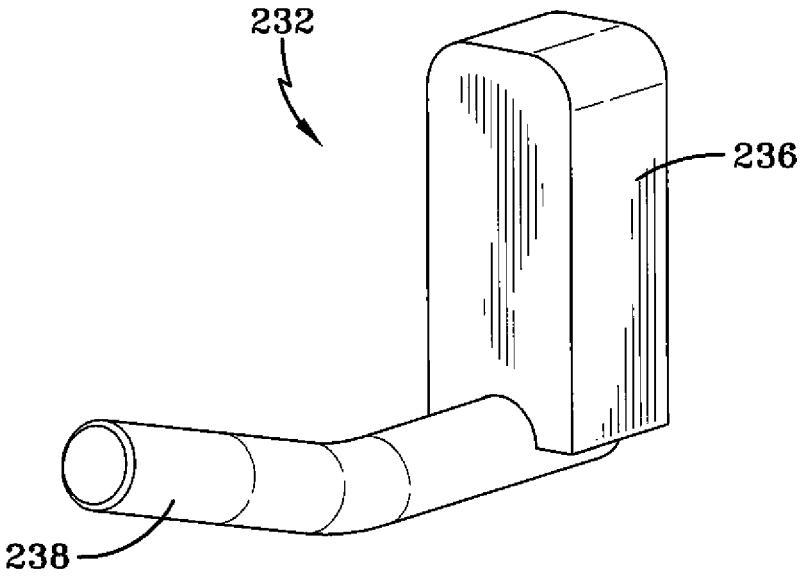
FIG. 13 is an enlarged view of an exemplary lag bolt weldment.

The fasteners 228 may provide a connection between the protective shield 10 and the vehicle on which it is mounted. In addition, for a vehicle such as an M1A1 Abrams tank, the protective shield 10 may be additionally fastened using a pair of lag bolt weldments 232 and flanges 234 disposed on opposite sides of the shield 10 (FIG. 2). FIG. 12 is an enlarged view of an exemplary flange 234 and FIG. 13 is an enlarged view of an exemplary lag bolt weldment 232. With particular reference to the tank commander's station on an M1A1 Abrams tank, the head 236 (FIG. 13) of the lag bolt weldment may mate with a drain opening in the revolving turret (not shown) of the commander's station. Fixing the lag bolt 238 to flange 234 with, for example, a nut 240 (FIG. 2) may help secure the shield 10 to the vehicle. Flanges 234 may be inserted through openings 68, 168 in the circular members 28 (FIGS. 8) and 128 (FIG. 9).

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An assembly for the hatch on the upper body of an M1A2 Abrams tank at the tank commander's weapon station, to conceal, to cover and to ballistically shield an operator, said assembly comprising:

a vertically positioned first shield device of sheet steel armor plating, with rectangular space for a window in a central region of said first shield device, said window being of laminated ballistic glass, wherein the sheet steel armor plating occupies the majority of the surface area of said first shield device, said first shield device having two rounded concave portions at its upper edge, one at each corner, and wherein a machine gun is attached at one of said concave portions upon a spring clip means, and wherein said first shield device has a narrow sill across its lower edge, said sill configured to being plane parallel to the upper body surface of the tank, and wherein said first shield device has two vertically positioned wings of flat solid sheet steel armor plating, each one bent in at an angle to the vertical plane of said central region of said first shield device so that they can be attached to a ring shaped circular base; and a lower portion of first shield device and the wings including viewing openings for accessing at least one periscope at a viewing opening;

a vertically positioned second shield device of sheet steel armor plating, with rectangular space for a window in a central region of said second shield device, said window being of laminated ballistic glass, wherein the sheet steel armor plating occupies the majority of the surface area of said second shield device, and wherein said second shield device has a narrow sill across its lower edge, said sill configured to being plane parallel to the upper body surface of the tank, and wherein said second shield device has two vertically positioned wings of flat solid sheet steel armor plating, each one bent in at an angle to the vertical plane of said central region of said second shield device so that they can be attached to a ring shaped circular base; and a lower portion of second shield device and the wings including viewing openings for accessing at least one periscope at a viewing opening, and wherein one of said first or said second shield device further includes a hatch stop for engaging an opened hatch;

said ring shaped circular base being fixedly attachable to said tank upper body at the hatch area of the tank commander's weapon station in an upright position perpendicular to said tank upper body said first shield device and said second shield device, said ring shaped circular base having an open area and base supports around its circumference to support it above the upper body of said tank, and which ring shaped circular base is also fixedly attached there to said tank upper body such that the hatch opening is fittable within the open area of said ring shaped circular base, and wherein the sides of said first shield device and second shield device that face each other define an open area there between to stand and further there are two, side openings between said first shield device and said first shield device through which an operator may ingress to or egress from said assembly while the operator is upon the tank upper body.

2. The assembly of claim 1 wherein the tank commander's hatch has a tank hatch turret opening and a cover for the hatch, and further includes at least one periscope.

3. The assembly of claim 1 wherein the wings on said first shield device and second shield device angle in within a range of about 30 to about 60 degrees.

4. The assembly of claim 1 wherein the windows on said first shield device and second shield device are held on by Z-shaped brackets and side bar portions, with gaskets for sealing on a window.

5. The assembly of claim 1 wherein said first shield device and second shield device includes a rack for a weapon, wherein said rack comprises a mounting bracket thereon.

6. The assembly of claim 1 wherein the steel on said first shield device and second shield device is at least about 0.5 inches thick.

7. The assembly of claim 1 wherein said ring shaped circular base has boss openings sized and shaped to accommodate therein inserted mating bosses of said first shield device and second shield device to mount said first shield device and second shield device therein.

8. The assembly of claim 1 wherein said ring shaped circular base is comprised of two substantially equal halves, connected by splice plates.

9. The assembly of claim 1 wherein said first shield device and second shield device have lag bolt weldments and flanges for attaching the shields to the tank's upper surface.

10. The assembly of claim 1 wherein the hatch stop prevents the commander's hatch from opening past its vertical position, and which further allows the commander's hatch to function as a further protective shield for the operator within the open area between said first shield device and second shield device.

* * * * *